US006027387A

United States Patent [19]

Allin

[11] Patent Number: 6,027,387

[45] Date of Patent: Feb. 22, 2000

[54] UNIVERSAL KAYAK ACCESSORY PADDLE MOUNTING BRACKET

[76] Inventor: Raymond V. Allin, 220 Bay View Ave., Berkley, Mass. 02779

[21] Appl. No.: 08/902,827

[22] Filed: Jul. 30, 1997

Related U.S. Application Data

[63] Continuation of application No. 08/803,345, Feb. 20, 1997, abandoned.

[51] Int. Cl.[7] ..... B63H 16/06

[52] U.S. Cl. ..... 440/104; 114/364

[58] Field of Search ..... 114/347, 343, 114/364; 440/101–104

[56] References Cited

U.S. PATENT DOCUMENTS

| | | | |
|---|---|---|---|
| 2,497,797 | 2/1950 | Rogers . | |
| 2,708,758 | 5/1955 | Gross . | |
| 3,701,436 | 10/1972 | Adams | 114/364 |
| 4,358,281 | 11/1982 | Woodward . | |
| 4,453,490 | 6/1984 | Miller | 440/104 |
| 4,623,315 | 11/1986 | Carter . | |
| 4,850,296 | 7/1989 | Slanker et al. . | |
| 5,134,964 | 8/1992 | Masters . | |
| 5,373,802 | 12/1994 | Krolick et al. . | |
| 5,501,169 | 3/1996 | Denker . | |
| 5,595,517 | 1/1997 | Smith | 440/104 |

OTHER PUBLICATIONS

Catelog from Easy Rider Conoe and Kayak Co. Cover sheet and pp. 3 and 4, Publication Date Unknown.

Canoe & Kayak Magazine, May 1996 Cover sheet and inside page (Easy Rider Advertisement).

*Primary Examiner*—Ed Swinehart

[57] ABSTRACT

The present invention is a mounting bracket for use with a kayak having a deck and a paddle having a median portion and a blade portion. In one embodiment, the bracket comprises first and second sides, first and second ends, an upper support surface adapted to receive the median portion of the paddle, a lower mounting surface adapted to engage with the deck of the kayak, and a strap disposed within a channel formed in the lower mounting surface. The strap is moveable from a first position whereby the median portion of the paddle may be removed from the upper support surface to a second position whereby the median portion of the paddle is secured within the upper support surface. The mounting bracket of the present invention allows quick and secure attachment of the paddle to a kayak for assisting in the re-entry of the kayak and can be easily mounted to a variety of kayaks.

9 Claims, 4 Drawing Sheets

UNIVERSAL KAYAK ACCESSORY PADDLE MOUNTING BRACKET

"This is a continuation of copending application(s) Ser. No. 08/803,345 filed on Feb.20, 1997 now abandoned".

FIELD OF THE INVENTION

The present invention relates generally to kayaks. More particularly, the present invention relates to accessory items for use with kayaks.

BACKGROUND OF THE INVENTION

In the last decade, sea kayaking as a recreational sport has rapidly increased in the amount of participants. Sea kayaking is a dangerous sport insomuch as the participant is constantly involved with various elements. One of the more prevailing hazards is that of capsizing the kayak wherein the participant finds himself in the water which generates an immediate need to regain access and reentry into the kayak for reasons of safety, comfort and continuation of activity. Capsizing also presents the hazards of losing the craft (which might float away while the participant is trying to rectify his situation), losing the paddle (which is the primary means of locomotion), or of prolonged immersion in the water which in some locations could expose the participant to potentially deadly conditions of hyperthermia. Also, the hazard of reentering the kayak is compounded when operating in rough or stormy waters.

Several methods or systems have been developed to assist the participant in re-entry into the kayak. One such method is commonly known as the "paddle float" method. In the paddle float method, a floatable or buoyance member is attached about the blade end of the paddle while the other end is secured underneath a series of tie-down or bungy cords attached to the deck at the forward end of the cockpit of the kayak. When the paddle is extended outward of the kayak the buoyance member (mounted upon the blade end of the paddle) causes the kayak to become relatively stable so long as the paddle is adequately attached to the kayak.

Systems or methods of the type exemplified by the "paddle float" method have several drawbacks. One principal drawback is that the stability of the device depends significantly upon how well the paddle is secured to the deck of the kayak. With such methods, the bungy cords are subject to weakening through the repeated stretching of the cords over time and also to the weakening of the elastics within the cord covering due to constant exposure to the ultraviolet light from the sun and to the decomposition of the elastic from the effects of water and/or salt water. Further, many manufacturers do not provide any bungy cord or tie-down systems as a standard feature on the kayaks. As such, the owner of the kayak must install the tie down cords after purchase which may result in a defective installation.

SUMMARY OF THE PRESENT INVENTION

One object of the present invention is to provide a mounting bracket which allows for the secure attachment of a paddle to a kayak for assisting in the reentry of the kayak.

Another object of the present invention is to provide a mounting bracket which allows the paddle to be quickly mounted or dismounted from the kayak.

A further object of the present invention is to provide a mounting bracket that is universally mountable upon a variety of kayaks.

The present invention is a mounting bracket for use with a kayak having a deck and a paddle having a median portion and a blade portion. In one embodiment, the bracket comprises first and second sides, first and second ends, an upper support surface adapted to receive the median portion of the paddle, a lower mounting surface adapted to engage with the deck of the kayak, and a strap disposed within a channel formed in the lower mounting surface. The strap is moveable from a first position whereby the median portion of the paddle may be removed from the upper support surface to a second position whereby the median portion of the paddle is secured within the upper support surface. The mounting bracket of the present invention allows quick and secure attachment of the paddle to a kayak for assisting in the re-entry of the kayak and can be easily mounted to a variety of kayaks.

BRIEF DESCRIPTION OF THE DRAWINGS

The following detailed description of the present invention will be more fully understood with reference to the accompanying drawings in which.

DETAILED DESCRIPTION OF THE PREFERRED EMBODIMENTS

Figure 1:
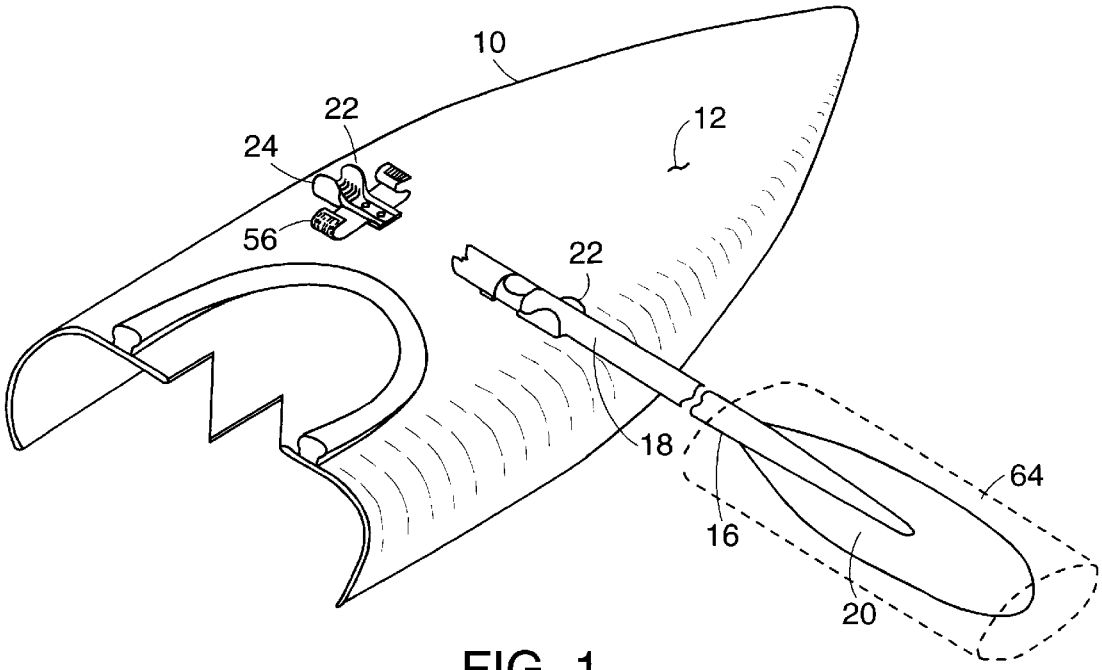
FIG. 1 is a perspective view showing the universal mounting bracket of the present invention mounted on the deck of a kayak.
Figure 2:
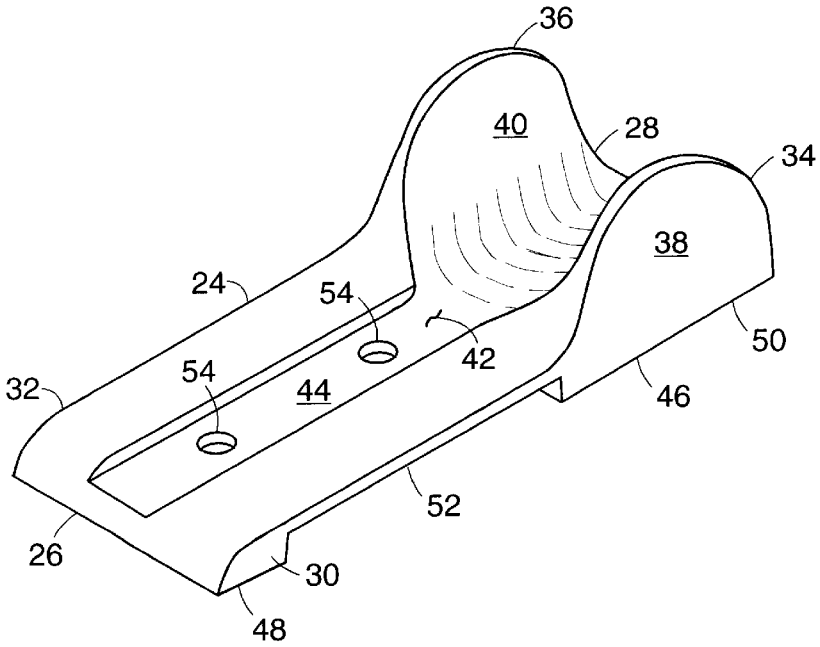
FIG. 2 is a perspective of the universal mounting bracket of the present invention.
Figure 5:
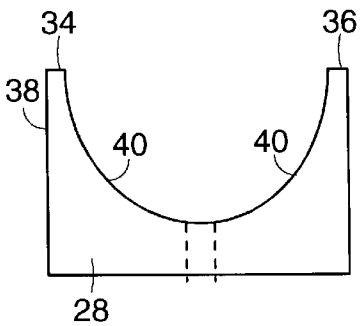
FIG. 5 is an end view of the universal mounting bracket.
Figure 4:
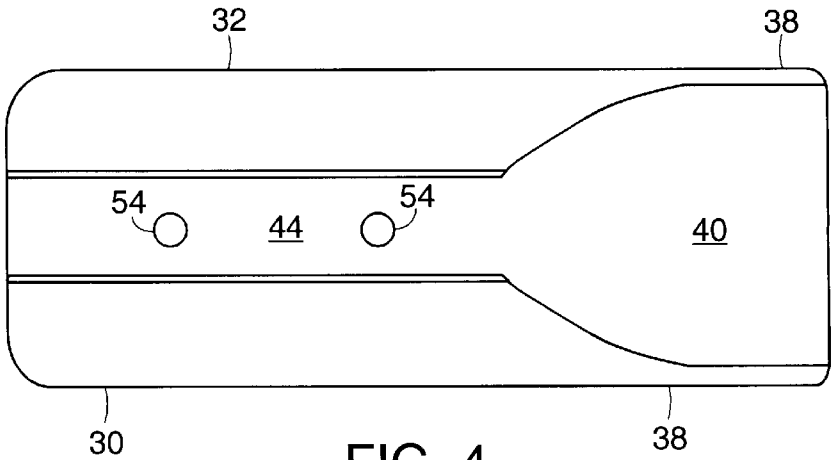
FIG. 4 is a top plan view of the universal mounting bracket.
Figure 3:
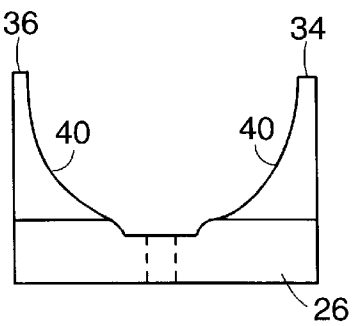
FIG. 3 is an end view of the universal mounting bracket.
Figure 6:
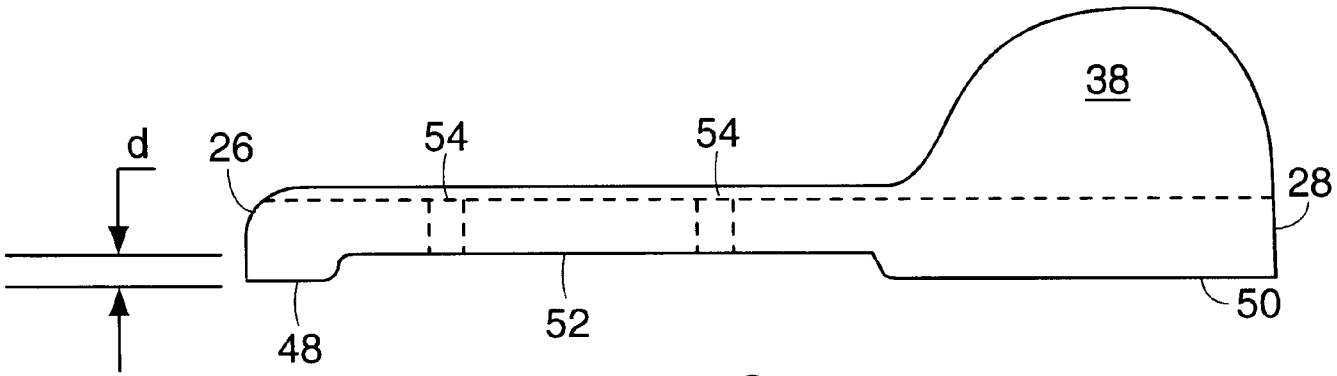
FIG. 6 is a front or elevational view of the universal mounting bracket.
Figure 7:
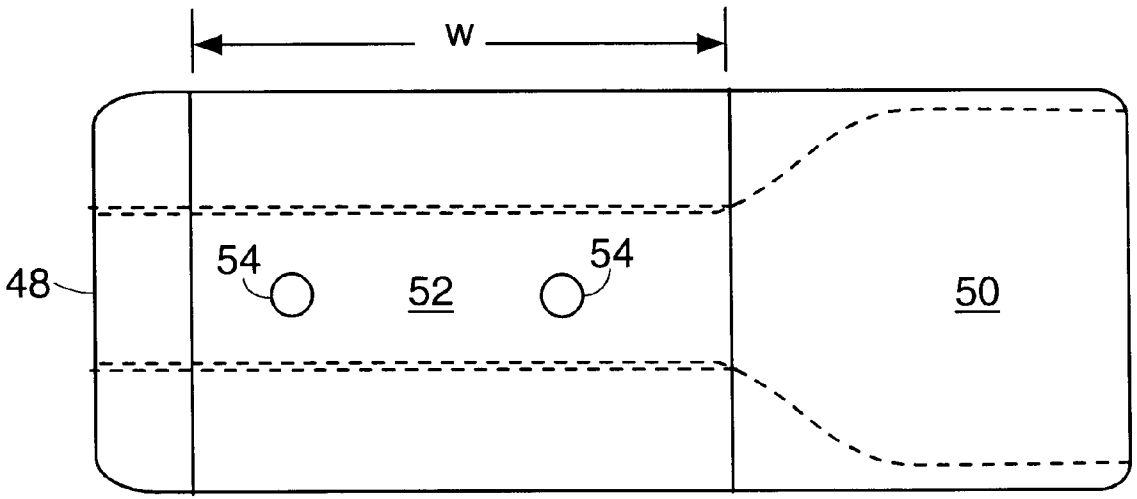
FIG. 7 is a bottom plan view of the universal mounting bracket.
Figure 8:
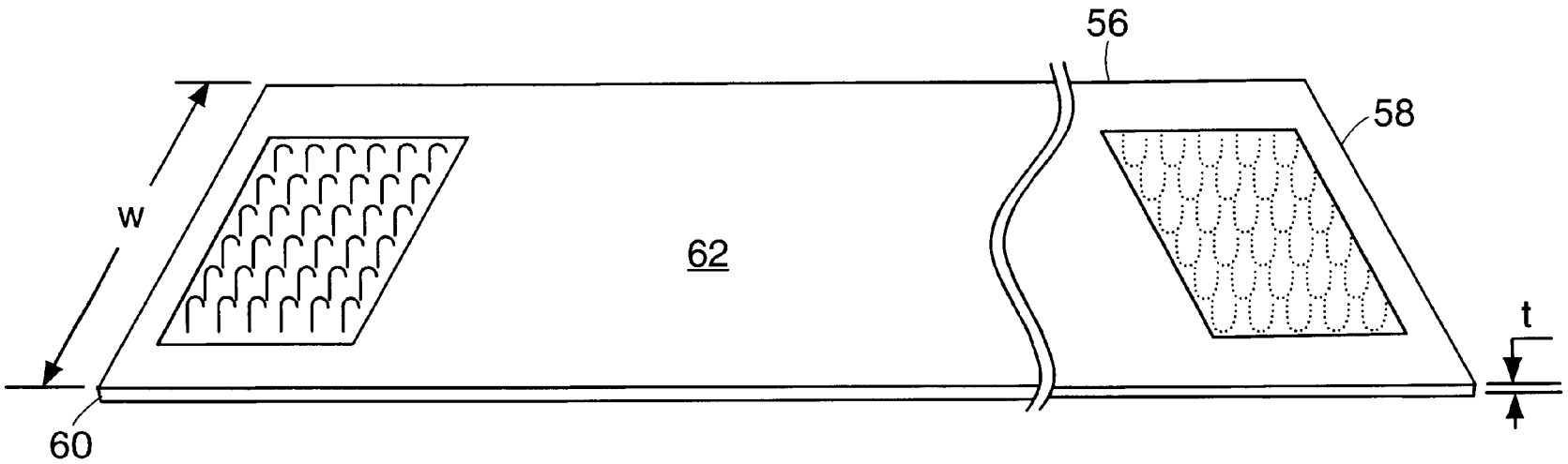
FIG. 8 is a plan view of the s trap.
Figure 9:
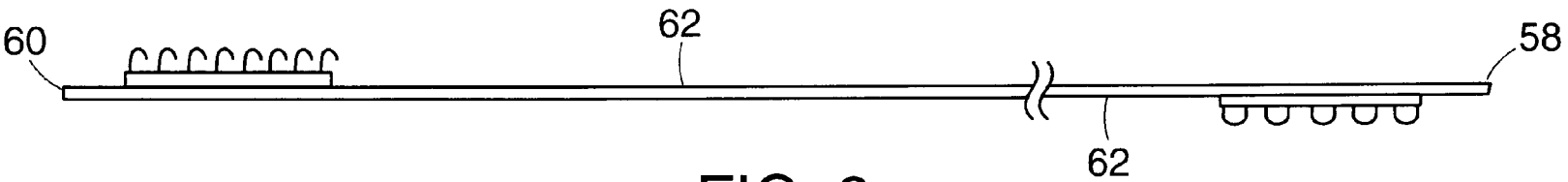
FIG. 9 is an elevation view of the strap.

Referring to FIG. 1 wherein two universal mounting bracket assemblies 22 of the present invention are shown mounted to the deck 12 of a kayak 10. Also shown is one-half of a typical kayak paddle 16 having a median portion 18 and a blade portion 20 securely supported within one of the mounting bracket assembly 22. The other half (not shown) of the paddle 16 is engaged with the other mounting bracket assembly 22 in the same manner.

Referring to FIGS. 2–8 wherein detailed views of the mounting bracket assemblies 22 are shown. Each mounting bracket assembly 22 generally comprises a bracket member 24 and a strap 56. The bracket member 24 generally comprising a first end 26, a second end 28, a first side 30 and a second side 32. The bracket member 24 further comprises a first side flange 34 and a second side flange 36 each comprising a generally planar outside surface 38 and a generally concave inside surface 40. The bracket member 24 further comprises an upper support surface 42 extending from the first end 26 to the second end 28 and which is generally U-shaped when bounded by the inside surfaces 40 of first side flange 34 and second side flange 36. Upper support surface 42 is adapted to support the median portion 18 of the paddle 16. First side flange 34 and second side flange 36 restrain lateral movement of the paddle 16 within the bracket member 24. The bracket member 24 further comprises a lower support surface 46 and a channel 52. The support surface 46 is adapted to provide a surface to engage with the deck 12 of the kayak 10. The channel 52 is adapted to allow the strap 56 to be secured mounted to the bracket member 22 without interference with securement of the lower support surface 46 to the deck 12 and/or the median portion 18 within the upper support surface 42. The channel 52 divides the lower support surface 46 into first and second mounting legs 48 and 50 each of which are substantially planar and/or otherwise shaped to meet the contour of the deck 12 so to provide a solid and smooth engagement to deck 12 thereby reducing and/or eliminating any movement of the bracket 10 relative to the deck 12. The channel 52 has a width w designed to meet the corresponding width of the strap 56 and a depth d larger than the thickness of the strap 56 so that when the strap 56 is mounted within the channel 52 it will not extend outward of the lower support surface 34 and interfere with the engagement of the support surface 46 to the deck 12. The bracket 10 further comprises a plurality of mounting holes 42 located within the channel 52 and upper recess 44. Mounting holes 54 are each adapted to allow a fastener (not shown) to pass therethrough and securely connect each bracket assembly 22 to the deck 12. The bracket 22 may be made from a variety of materials and manufactured by variety of processes. Preferably, the bracket 22 is made from a material such as aluminum and/or high strength plastic which are substantially rust proof and durable in salt water conditions and which are easy to manufacture by casting and/or injection molding processes.

The strap 56 generally comprises a first end 58, a second end 60 and a median portion 62. The strap 56 is also defined by a width w and a thickness t. First end 58 and second end 60 are provided with suitable fasteners such as Velcro so as to allow the first end 58 to be quickly connected and disconnected from the second end 60. Strap 56 may be made from a variety of materials and manufactured by variety of processes. Preferably, the strap 56 is made from a material such as nylon which is flexible and durable in salt water conditions.

In operation, each of the bracket assemblies 22 are mounted to the deck 12 of the kayak 10 by inserting the median portion 62 of the strap 56 with the channel 52 of the bracket 22. Thereafter, fasteners (not shown) are inserted through mounting holes 54 through the strap 56 and into the deck 12 of the kayak. The bracket assemblies 22 are mounted such that the upper support surfaces 42 of each bracket assembly 24 are in axial alignment to allow the median portion 18 of the paddle 16 to be engaged with both bracket assemblies 22. The bracket assemblies 22 may be used in a variety of ways. For example, if the participant capsizes the kayak during operation, the participant while in the water can place the paddle 16 with each of brackets 22 of bracket assemblies 22 and thereafter secure the paddle 16 to the bracket assemblies 22 by engaging the first end 58 of strap 56 over the median portion 18 of the paddle and connecting the same to the second end 60. In this orientation shown in the drawings, the paddle 16 would extend outward and be orientated substantially 90 degrees to the longitudinal axial of the kayak 10. With the paddle 16 securely connected to each of the bracket assemblies 22 and the buoyancy member 64 placed about the blade portion 20, the kayak 10 becomes relatively stable in the water allowing the participant to place his weight on the paddle 16 and/or the kayak 10 to gain re-entry.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device for use with a kayak having a deck and a paddle having a median portion and a blade portion and a bouyancy member mountable about the blade portion, the device comprises:

(a) a bracket member comprising first and second sides, first and second ends, an upper support surface extending from said first end to said second end and being adapted to receive the median portion of the paddle, a lower mounting surface adapted to engage with the deck of the kayak, and a channel disposed within said lower mounting surface, said channel having a depth and extending from said first side to said second side; and (b) a strap having first and second ends, a median portion and a thickness, said median portion being disposed within said channel, said first and second ends being moveable from a first position whereby the median portion of the paddle may be removed from said upper support surface to a second position whereby the median portion of the paddle is secured within said upper support surface.

2. The mounting bracket of claim 1 further comprising first and second side flanges extending upward from said upper support surface and adapted to restrain lateral movement of the median portion of the paddle.

3. The mounting bracket of claim 2, wherein each of said first and second side flanges comprise a generally concave shaped inside surface.

4. The mounting bracket of claim 1, wherein said depth of said channel is greater than said thickness of said strap.

5. A mounting system for use with a kayak having a deck and a paddle having first and second median portions and first and second blade portions, the system comprises:

(a) a first bracket assembly comprising a bracket member comprising first and second sides, first and second ends, an upper support surface extending from said first end to said second end and being adapted to receive the first median portion of the paddle, a lower mounting surface adapted to engage with the deck of the kayak, and a channel disposed within said lower mounting surface, said channel having a depth and extending from said first side to said second side; and a strap having first and second ends, a median portion and a thickness, said median portion being disposed within said channel, said first and second ends being moveable from a first position whereby the first median portion of the paddle may be removed from said upper support surface to a second position whereby the first median portion of the paddle is secured within said upper support surface; and (b) a second bracket assembly comprising a bracket member comprising first and second sides, first and second ends, an upper support surface extending from said first end to said second end and being adapted to receive the second median portion of the paddle, a lower mounting surface adapted to engage with the deck of the kayak, and a channel disposed within said lower mounting surface, said channel having a depth and extending from said first side to said second side; and a strap having first and second ends, a median portion and a thickness, said median portion being disposed within said channel, said first and second ends being moveable from a first position whereby the second median portion of the paddle may be removed from said upper support surface to a second position whereby the second median portion of the paddle is secured within said upper support surface.

6. The system of claim 5, wherein each of said brackets further comprise first and second side flanges extending upward from said upper support surface and adapted to restrain lateral movement of the first and second median portions of the paddle.

7. The system of claim 6, wherein each of said first and second side flanges comprise a generally concave shaped inside surface.

8. The system of claim 5, wherein said depth of said channel is greater than said thickness of said strap.

9. The system of claim 5, wherein said first bracket assembly is positioned in axial alignment with said second bracket assembly such that the first and second median portions of the paddle can be mounted therein.

* * * * *